United States Patent [19]

Mumpower, II

[11] Patent Number: 4,729,390

[45] Date of Patent: Mar. 8, 1988

[54] TOBACCO SMOKE FILTERING MATERIAL

[75] Inventor: Robert C. Mumpower, II, Gray, Tenn.

[73] Assignee: Eastman Kodak Company, Rochester, N.Y.

[21] Appl. No.: 760,802

[22] Filed: Jul. 31, 1985

[51] Int. Cl.[4] ..... A24D 3/08; A24D 3/14

[52] U.S. Cl. ..... 131/331; 131/332; 131/343; 131/345

[58] Field of Search ..... 131/331, 332, 343, 345

[56] References Cited

U.S. PATENT DOCUMENTS 3,417,759 12/1968 Touey et al. ..... 131/343

3,424,173 1/1969 Touey et al. ..... 131/343

*Primary Examiner*—V. Millin

*Attorney, Agent, or Firm*—John F. Stevens; William P. Heath, Jr.

[57] ABSTRACT

Disclosed are tobacco smoke filtering materials for selectively removing deleterious material from tobacco smoke without at the same time removing desirable smoke vapors which contribute to aroma and taste. The filtering materials comprise a fibrous article, the fibers of which have a coating on the surfaces thereof comprising a compound of the formula

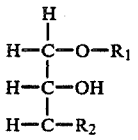

wherein $R_1$ is the residue of a straight chain fatty acid having 8–22 carbon atoms and $R_2$ is OH or

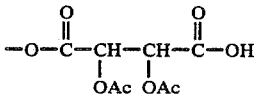

wherein Ac is an acetyl group.

5 Claims, No Drawings

TOBACCO SMOKE FILTERING MATERIAL

TECHNICAL FIELD

This invention relates to a tobacco smoke filtering material for selectively removing deleterious materials from tobacco smoke without at the same time removing desirable smoke vapors which contribute to aroma and taste. More particularly, this invention concerns a novel cigarette filter tow and filters made therefrom, as well as the method for their manufacture, which will selectively remove nicotine from cigarette smoke.

BACKGROUND ART

The harmful physiological effects of certain constituents contained in tobacco smoke have long been recognized. It is well known, for example, that tobacco smoke contains certain solid tar constituents and health-affecting materials from tobacco smoke by either using various types of tobacco smoke filters attached to the smoking device, or incorporating certain preventive compounds into the tobacco being smoked.

For certain types of tobacco, it is desirable to remove a higher percentage nicotine than tar (as defined by the Federal Trade Commission) to achieve a balance of taste, aroma, undesirable constituents, etc. Throughout the history of cigarette filtration, there has been a desire to selectively remove nicotine from tobacco smoke due to its toxicity. As of the present time, the use of a tobacco smoke filter element placed on the tip of the smoking device is the method or device most commonly used for removing these undesirable components from tobacco smoke. These filters, which normally consist of a bundle of cellulose acetate, convoluted crepe paper, cotton, or combinations of these products formed into a cylindrical plug, are designed to and do remove varying proportions of the liquid-solid particles passing through them, thereby greatly reducing the amount of undesirable materials reaching the smoker's mouth. This liquid-solid particle filtering action is accomplished by a combination of diffusional, impactive, and direct collision of the particles with the filter material. Upon collision the particles are retained in the filter by the surface attraction between the extremely small particles and the relatively large filter material. Thus, filters of this type are capable of removing varying percentages of tar and nicotine from cigarette smoke depending on the amounts of fibrous material compacted into them, their length, their resistance to draw, the surface characteristics of the fibers, and other factors.

Most prior known fibrous filters show no selectivity for the removal of nicotine from the smoke of a cigarette, particularly when the tobacco involved is the conventional type used on domestic cigarettes. This type usually consists of a blend of bright, burley, and Turkish tobaccos with the bright ("flue cured") tobacco constituting the major portion of the blend. Filters of cotton, paper, or cellulose acetate fibers, when attached to such domestic cigarettes, always remove about the same percentage of nicotine from the smoke as they do tar. For example, if one of these filters removes 25% of the tar, it also removes about 25% of the nicotine; if it removes 40% of the tar, it also removes about 40% of the nicotine. Therefore, it can be said that these show no selectivity for removing nicotine over tar.

It has been suggested that one way to make a fibrous filter of cellulose acetate, paper or cotton remove a higher percentage of nicotine than tar from cigarette smoke is to coat the fibers in the filter with acids and particularly with nontoxic, nonvolatile organic acids such as tannic acid, citric acid, glutaric acid and the like. However, such a technique leaves something to be desired from the standpoint of the taste of the filter. Also, in the case of filters of cellulose acetate fibers, the addition of an acid can cause hydrolytic degradation of the fibers on prolonged contact. As a result, acetic acid can be released from the filter giving it an objectionable odor and taste.

U.S. Pat. Nos. 3,417,759 and 3,424,173 describe cigarette filter elements consisting of fibrous filters containing liquid additives (1,4 butanediol and 1,2,4 butanetriol respectively) that selectively remove nicotine from cigarette smoke.

According the the present invention a convenient and effective method has been found by which a tobacco smoke filter can be constructed for the selective removal of nicotine from tobacco smoke. This method consists of coating or otherwise dispersing a particular coating compound on the filtering material from which the tobacco smoke filter element is formed.

Therefore, this invention provides tobacco smoke filters which remove a higher percentage of nicotine than tar from tobacco smoke. Also, this invention provides additives for a tobacco smoke filter which impart to the filter an improved capacity for removing nicotine from tobacco smoke.

DESCRIPTION OF THE INVENTION

According to the present invention, there is provided a tobacco smoke filter adapted to remove certain undesirable components from tobacco smoke. The filter comprises a bundle of continuous filaments having a coating on the surfaces thereof comprising a compound of the formula

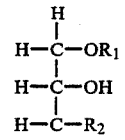

wherein $R_1$ is the residue of a straight chain fatty acid having 8–22 carbon atoms and $R_2$ is OH or

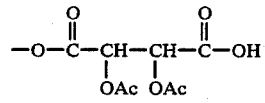

wherein Ac is an acetyl group, said compound having an iodine value of about 20–40, and being present in an amount of about 1–10% based on the weight of said filaments.

Where $R_2$ is OH, the compound is a monoglyceride and where $R_2$ is the indicated structural group, the compound is diacetyl tartaric acid ester of monoglycerides.

Conventional tobacco smoke filter material may be used such as fibrous products of cotton, paper, regenerated cellulose, cellulose acetate, polyolefins or any other suitable fibrous carrier medium having large surface areas that can be coated. However, the preferred carrier for these are the surface of cellulose acetate fibers in the form of crimped tow. These fibrous filter products are commonly formed into a bundle of about 4000 to 35,000 filaments of a denier of about 16 to about 1 and having about 4–40 crimps per inch formed into a cylindrical rod, wrapped with a covering such as paper, cut into individual cigarette filters and subsequently joined to the cigarette.

Coating compounds defined structurally above include partially saturated monoglycerides and diacetyl tartaric acid esters of partially saturated monoglycerides. The partially saturated monoglycerides have iodine values of about 20–40, preferably about 25–35. Such monoglycerides are prepared in a conventional manner by the glycerolysis of oils or fats which contain mixtures of partially saturated straight chain fatty acids having 8–22 carbon atoms. Common oils and fats include lard, tallow, cottonseed oil, palm oil, soybean oil, peanut oil, corn oil, sunflower oil and the like. Edible beef tallow is preferred because it contains acids having the preferred degree of saturation or iodine value.

The term "monoglyceride" as used herein is intended to include blends which contain quantities of diglycerides and triglycerides. Normally, monoglycerides will contain up to about 40% diglycerides and triglycerides, but it is preferred that blends contain at least 90% monoglycerides.

The diacetyl tartaric acid esters of monoglycerides may be prepared in conventional manner by reacting diacetyl tartaric acid anhydride with monoglycerides. Diacetyl tartaric acid anhydride may be prepared in conventional manner by reacting acetic anhydride with tartaric acid. Such reactions and techniques are well known in the art. See, for example, U.S. Pat. No. 2,938,027.

Commercially available coating compounds described structurally above include Myverol 18–30 emulsifier (monoglyceride) and Myvatem 30 dispersing aid (diacetyl tartaric acid anhydride ester of monoglyceride), both marketed by Eastman Chemical Products, Incorporated. Myverol 18–30 emulsifier is a monoglyceride prepared by glycerolysis of tallow. Myvatem 30 dispersing aid is the diacetyl tartaric acid ester of monoglycerides which have been prepared by glycerolysis of tallow. Both have iodine values of about 30.

The coating compound may be applied to the filter material by conventional means. It may be applied as a solution, emulsion, melt, etc. Application from a solution is preferred. The coating compound may be applied by brush, roller, spraying, or any means known in the art.

The amount of additive needed to selectively remove the nicotine from the effluent stream of tobacco smoke has been found to be between 1 and 10% by weight of the filter material. Amounts greater than 10% tend to make the filter plug wrap "greasy" and interfere with the adhesives used to bond paper wrap on the filter.

As will be appreciated, the addition of the distilled monoglyceride derivatives to a filter does not preclude the possibility that other liquid additives can be added to it for other purposes. For example, in the case of filters made from a crimped tow of cellulose acetate fibers it is highly desirable that this material be treated with certain high boiling plasticizers prior to the final rod formation to impart rigidity to the filter rod. Thus, it is common to use such room temperature bonding agents as glycerol triacetate or polyethylene glycol diacetates for this purpose. In such a case, this additive can be incorporated in the plasticizer and heated to 35° C. and applied by conventional filter making equipment to the filter. The additive has little or no effect on the bonding properties of the plasticizer.

The following examples are submitted for a better understanding of the invention.

Tobacco smoke filters are prepared on a production-type filter making machine equipped with a brush applicator of the type commonly used to apply plasticizer to cellulose acetate tow. The brush applicator is fitted with electric heaters to maintain the applicated solution at 50° C. The plasticizer mixtures shown in Table I are applied to crimped 3.0 denier per filament 35,000 total denier cellulose acetate filter tow and converted to cigarette filter rods. All the finished filter rods contain 8% glycerol triacetate and either 1%, 2%, or 3% of the additives depending on which plasticizer-additive mixture is used. The filter rods are cut into 21 mm tips and attached to 63 mm tobacco columns from domestic filter cigarettes. The assembled cigarettes are conditioned for 48 hours at 60% relative humidity (72° F.) before being smoke tested.

The cigarettes are smoke tested in accordance with the procedure described in the Federal Trade Commission's Report of Tar, Nicotine, and Carbon Monoxide Content of the Smoke of 187 Varieties of Cigarettes (April, 1981). The nicotine content of the smoke is measured by the gas chromatographic procedure described by Mumpower and Kiefer in Tobacco Science XI, 144–147 (1967). Additional cigarettes are smoked and the cambridge filter pads (collected smoke) are slurried in water for subsequent pH measurements. The percent tar and nicotine removed by the filters is calculated using the following formulas:

$$\% R = \frac{A - D}{A} \times 100$$

$A$ = Available tar or nicotine
$D$ = Delivered tar or nicotine

A summary of test data is shown in Table 2. The test data shows that the filter with 2 and 3% of the additives removes significantly higher amounts of nicotine than tar from the test cigarettes without a measurable effect on the smoke pH. Smoke pH should not change appreciably due to the filter. The control cigarettes contain only triacetin on the filters.

TABLE 1

| Plasticizer-Additive Mixtures | |
|---|---|
| 1. 88% Glycerol triacetate | 12% Myvatem 30 dispersing agent |
| 2. 80% Glycerol triacetate | 20% Myvatem 30 dispersing agent |
| 3. 70% Glycerol triacetate | 30% Myvatem 30 dispersing agent |
| 4. 88% Glycerol triacetate | 12% Myverol 18–30 emulsifier |
| 5. 80% Glycerol triacetate | 20% Myverol 18–30 emulsifier |
| 6. 70% Glycerol triacetate | 30% Myverol 18–30 emulsifier |
| 7. 100% Glycerol triacetate | |

[1]The mixtures are not miscible at room temperature, however, when heated above 35° C. all samples were miscible.

TABLE 2

| Summary of Test Data | | | | | | |
|---|---|---|---|---|---|---|
| Additive[1] | Tar (T) | Nicotine (N) | % T | % N | N/T | pH |
| Available from unfiltered cigarettes | 30.1 | 2.02 | | | .0670 | 5.95 |

TABLE 2-continued

| Additive[1] | Summary of Test Data Tar (T) | Nico-tine (N) | % T | % N | N/T | pH |
|---|---|---|---|---|---|---|
| 3% Myverol 18-30 emulsifier | 16.9 | 1.00 | 44 | 50 | .0593 | 6.2 |
| 2% Myverol 18-30 emulsifier | 17.2 | 1.09 | 43 | 46 | .0636 | 6.2 |
| 1% Myverol 18-30 emulsifier | 17.3 | 1.23 | 42 | 39 | .0696 | 6.2 |
| Control filter cigarette without additive | 17.4 | 1.21 | 42 | 40 | .0696 | 6.2 |
| 3% Myvatem 30 dispersing agent | 17.8 | 1.11 | 41 | 45 | .0621 | 6.3 |
| 2% Myvatem 30 dispersing agent | 17.4 | 1.18 | 42 | 42 | .0677 | 6.2 |
| 1% Myvatem 30 dispersing agent | 17.5 | 1.27 | 42 | 37 | .0726 | 6.1 |

[1]All filters are 3.0 D/F 35,000 T.D. tow containing 8% triacetin and indicated amount of additive.
The iodine values specified herein are measured in accordance with AOCS Official Method Cd 1-25 (rev. April 1956). Official and Tentative Methods of the American Oil Chemists Society, 2nd ed., additions and revisions 1947 through 1963, inclusive.

Unless otherwise specified, all parts, percentages, ratios, etc., are on a weight basis.

The invention has been described in detail with particular reference to preferred embodiments thereof, but it will be understood that variations and modifications can be effected within the spirit and scope of the invention.

I claim:

1. A tobacco smoke filter adapted to remove certain undesirable components including tar and nicotine from tobacco smoke, said filter being comprised of a bundle of continuous filaments having a coating on the surfaces thereof comprising a compound of the formula

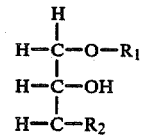

wherein $R_1$ is the residue of a straight chain fatty acid having 8–22 carbon atoms and $R_2$ is OH or

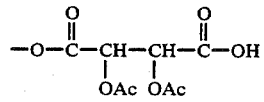

wherein Ac is an acetyl group, said compound having an iodine value of about 20–40, and being present in an amount of about 1–10% based on the weight of said filaments.

2. A tobacco smoke filter according to claim 1 wherein the filter comprises cellulose acetate filaments.

3. A tobacco smoke filter according to claim 1 wherein $R_2$ is OH.

4. A tobacco smoke filter according to claim 1 wherein $R_2$ is the moiety of diacetyl tartaric acid.

5. A tobacco smoke filter according to claim 1 wherein said compound has an iodine value of about 25–35.

* * * * *